United States Patent [19]

Eshleman et al.

[11] Patent Number: 4,693,223

[45] Date of Patent: Sep. 15, 1987

[54] FUEL INJECTION VALVE CONNECTION

[75] Inventors: Edgar S. Eshleman, Holcomb; Martin J. Field, Churchville; James L. Penwright, Gasport, all of N.Y.

[73] Assignee: General Motors Corporation, Detroit, Mich.

[21] Appl. No.: 622,953

[22] Filed: Jun. 21, 1984

[51] Int. Cl.[4] ..... F02M 39/00

[52] U.S. Cl. ..... 123/468; 123/470

[58] Field of Search ..... 123/468, 469, 470, 471, 123/472

[56] References Cited

U.S. PATENT DOCUMENTS

| | | | |
|---|---|---|---|
| 2,833,260 | 5/1958 | Dolza | 123/471 |
| 2,872,217 | 2/1959 | May | 285/45 |
| 3,777,977 | 12/1973 | Regneault | 239/96 |
| 3,783,842 | 1/1974 | Kuhn | 123/469 |
| 3,872,891 | 3/1975 | Chamberlain | 138/177 |
| 3,929,109 | 12/1975 | Chamberlain | 123/468 |
| 4,286,563 | 9/1981 | Fahim | 123/469 |
| 4,327,690 | 5/1982 | Sauer | 123/469 |
| 4,395,988 | 8/1983 | Knapp | 123/469 |

FOREIGN PATENT DOCUMENTS

| | | | |
|---|---|---|---|
| 683285 | 6/1930 | France | 123/470 |

*Primary Examiner*—Carl Stuart Miller

*Attorney, Agent, or Firm*—C. K. Veenstra

[57] ABSTRACT

A fuel connector has a projection with a threaded external surface that mates with the threaded internal surface of a fuel injection valve fitting, and also has a sleeve surrounding the fitting. An O-ring engages the internal surface of the sleeve and the external surface of the fitting and allows the valve to be rotated relative to the connector without breaking the sealing engagement between the valve and the connector.

1 Claim, 3 Drawing Figures

FUEL INJECTION VALVE CONNECTION

TECHNICAL FIELD

This invention relates to a connection between a fuel injection valve and a fuel connector which allows the valve to be rotated relative to the connector as the valve is installed on an engine.

BACKGROUND

In applying a port fuel injection system to an automotive internal combustion engine, each of a plurality of fuel injectors is mounted to deliver fuel to an inlet port of an associated engine combustion chamber. In some such applications, an additional fuel injection valve is mounted to deliver fuel to all of the engine combustion chamber inlet ports to provide additional the fuel required to start the engine at very low temperatures.

To simplify installation of the fuel injectors on the engine, the fuel injectors may be mounted in sockets of a fuel rail which has a passage to supply fuel to the injectors. However, the fuel rail does not necessarily simplify installation of the additional, cold start fuel injection valve on the engine.

SUMMARY OF THE INVENTION

This invention provides a fuel injection valve connection which allows a supplemental, cold start fuel injection valve to be readily installed on the engine.

In a fuel injection valve connection according to this invention, the fuel injection valve has an inlet fitting with a threaded internal surface and a cylindrical external surface, while the fuel connector has a projection with a threaded external surface that mates with the threaded internal surface of the fitting. The connector also has a sleeve surrounding the fitting, and an O-ring seals radially against the internal surface of the sleeve and the external surface of the fitting.

With this connection, the valve may be rotated relative to the connector to allow proper orientation of the valve on the engine without breaking the sealing engagement between the valve and the connector.

The details as well as other features and advantages of a preferred embodiment of this invention are set forth in the remainder of the specification and are shown in the accompanying drawing.

SUMMARY OF THE INVENTION

THE PREFERRED EMBODIMENT

Figure 1:
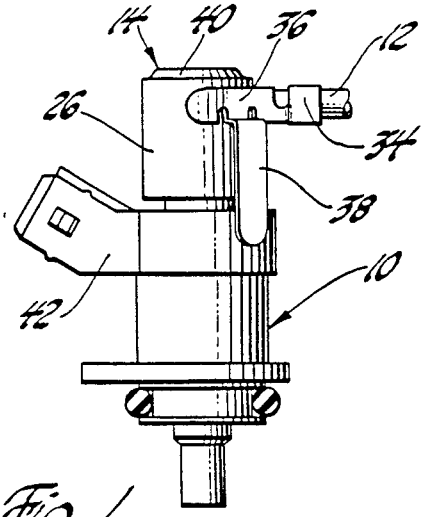
FIG. 1 is an elevational view of a cold start fuel injection valve having a connection according to this invention.

Referring to the drawing, a cold start fuel injection valve 10 is constructed to deliver fuel to the manifold of an internal combustion engine (not shown). Fuel is delivered to valve 10 through a fuel line or tube 12 and a connector 14.

Figure 2:
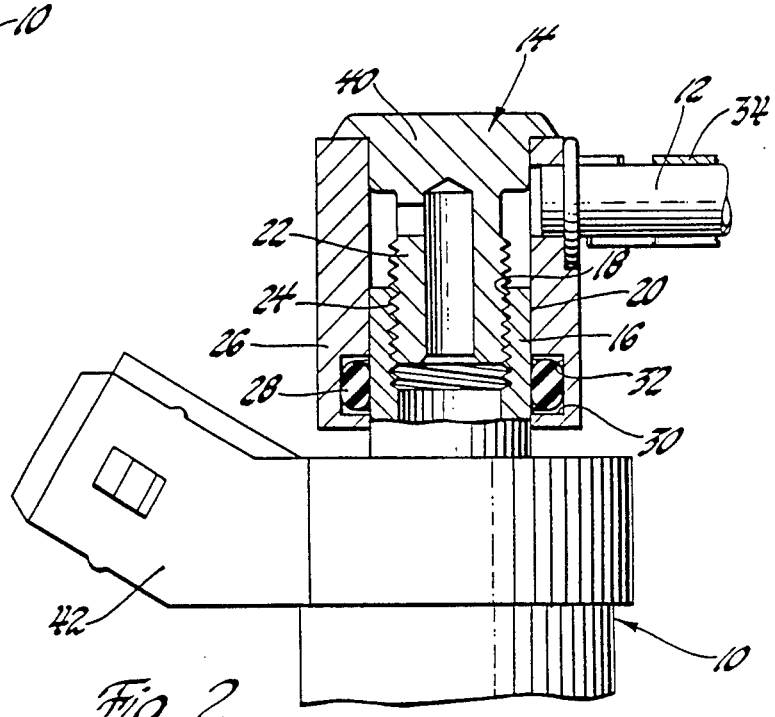
FIG. 2 is a view of a portion of FIG. 1, enlarged and having parts broken away to show the details of construction.

As shown in FIG. 2, valve 10 has an inlet fitting 16 with an internal thread 18 and a cylindrical external surface 20. Connector 14 includes a projection 22 having an external thread 24 that mates with the internal thread 18 on fitting 16. Connector 14 also has a sleeve 26 surrounding fitting 16.

An O-ring 28 is retained in a groove 30 inside sleeve 26 and seals radially against both the external surface 20 of fitting 16 and the internal surface 32 of sleeve 26.

Figure 3:
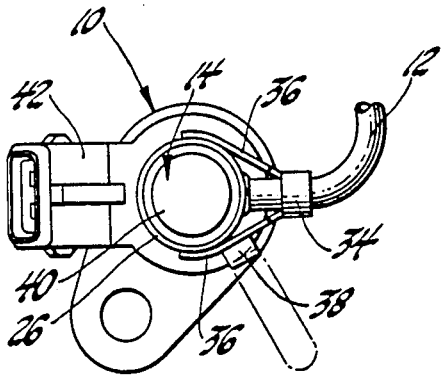
FIG. 3 is a plan view of the FIG. 1 connection, further showing how a tab is bent to prevent unthreading of the valve from the connector.

As shown in FIGS. 1 and 3, a bracket 34 embraces fuel tube 12 and has a pair of legs 36 embracing connector 14. Bracket 34 supports fuel tube 12 on fuel connector 14. Bracket 34 has a tab 38 which is bent downwardly after assembly of valve 10 to connector 14.

Tube 12 is brazed to connector sleeve 26, connector sleeve 26 is brazed to the member 40 containing projection 22, and bracket 34 is brazed to tube 12 and connector sleeve 26.

Valve 10 is assembled to connector 14 by threading fitting 16 onto projection 22. After tab 38 is bent downwardly as shown in FIG. 1, the relative orientation of valve 10 and connector 14 may be varied, but tab 38 will engage the electrical connector 42 on valve 10 to prevent unthreading of valve 10 from connector 14. Valve 10 and connector 14 accordingly may be installed on an engine, and valve 10 may then be rotated relative to connector 14 to properly orient valve 10 on the engine.

It will be appreciated that, in some applications, O-ring 28 could be retained in an external recess on fitting 16 rather than in the internal recess 30 of sleeve 26.

The embodiments of the invention in which an exclusive property or privilege is claimed are defined as follows:

1. A fuel injection valve connection comprising a fuel injection valve having a cylindrical inlet fitting, said fitting having a threaded internal surface and a cylindrical external surface, a fuel connector having a projection with a threaded external surface that mates with the threaded internal surface of said fitting, said connector also having a sleeve with a cylindrical internal surface surrounding said fitting and an O-ring sealingly engaging said internal surface of said sleeve and said external surface of said fitting, whereby said valve may be rotated relative to said connector without breaking the sealing engagement between said valve and said connector, and wherein said connector also has a tab engageable with said injector to prevent unthreading of said valve from said connector.

* * * * *